US007555234B2

(12) United States Patent
Elliot et al.

(10) Patent No.: US 7,555,234 B2
(45) Date of Patent: Jun. 30, 2009

(54) SCHEDULING SYSTEM FOR PLACING TEST PATCHES IN A PRINTING APPARATUS

(75) Inventors: Michael W. Elliot, Penfield, NY (US); Michael J. Dahrea, Rochester, NY (US); Stephen F. Randall, West Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 482 days.

(21) Appl. No.: 11/517,163

(22) Filed: Sep. 7, 2006

(65) Prior Publication Data

US 2008/0063420 A1 Mar. 13, 2008

(51) Int. Cl.
*G03G 15/00* (2006.01)

(52) U.S. Cl. ..... 399/72

(58) Field of Classification Search ..... 399/49, 399/72

See application file for complete search history.

(56) References Cited

U.S. PATENT DOCUMENTS

| | | | | |
|---|---|---|---|---|
| 5,504,568 | A | 4/1996 | Saraswat et al. | |
| 6,167,217 | A | 12/2000 | Kelsch et al. | |
| 6,385,408 | B1 | 5/2002 | Scheuer | |
| 6,526,240 | B1 * | 2/2003 | Thomas et al. | 399/72 |
| 7,027,748 | B2 * | 4/2006 | Funatani | 399/49 |
| 7,224,919 | B1 * | 5/2007 | Shemirani et al. | 399/72 |
| 7,324,769 | B2 * | 1/2008 | Yamaoka | 399/49 |
| 7,418,216 | B2 * | 8/2008 | Elliot et al. | 399/49 |

* cited by examiner

*Primary Examiner*—William J Royer
(74) *Attorney, Agent, or Firm*—Ronald E. Press, Jr.; Prass LLP

(57) ABSTRACT

A method of operating a printing apparatus, the apparatus having a rotatable imaging member and an imaging station useful in creating printable images and test patches on the rotatable imaging member. Data is obtained relating to images desired to be printed in a time-frame corresponding to a predetermined number of rotations of the imaging member. A gap is identified in the time-frame corresponding to a location on the imaging member that is not occupied by an image desired to be printed within the time-frame. The identified gap is identified as suitable for receiving a test patch.

4 Claims, 3 Drawing Sheets

SCHEDULING SYSTEM FOR PLACING TEST PATCHES IN A PRINTING APPARATUS

CROSS-REFERENCE TO RELATED APPLICATION

The following patent applications are being filed simultaneously herewith: SYSTEM FOR PREDICTING ERASURE OF TEST PATCHES IN A PRINTING APPARATUS, U.S. patent application Ser. No. 11/516,898, Michael W. Elliot, et al. and SCHEDULING SYSTEM FOR PLACING TEST PATCHES OF VARIOUS TYPES IN A PRINTING APPARATUS, U.S. patent application Ser. No. 11/516,838, Bejan M. Shemirani, et al.

TECHNICAL FIELD

The present disclosure relates to digital printing systems, such as those using xerography.

BACKGROUND

Many printing technologies, such as xerography and ink-jet printing, exploit a rotatable imaging member on which an image is first created with marking material, such as liquid ink or powdered toner, and then transferred to a print sheet. When controlling such a printing apparatus, it is common to place on the imaging member at various times "test patches," meaning areas of marking material of predetermined desired properties such as optical density, and then measuring the actual properties of each test patch as part of an overall control process.

In some embodiments of printing apparatus, the test patches are placed on the imaging member, and tested for certain properties; but the marking material forming each test patch is never transferred to a print sheet. In such cases, the marking material forming the test patches has to be cleaned off, such as by a cleaning device within the apparatus. In some situations, the imaging member has to cycle multiple times past the cleaning device to remove the marking material sufficiently from the patch area. On the intermediate cycles before the marking material on the test patch is completely removed, the area around the test patch cannot be used for placing of images.

U.S. Pat. Nos. 6,167,217 and 6,385,408 disclose basic systems for scheduling the creation of test patches in a xerographic printer. U.S. Pat. No. 5,504,568 discloses a system in which images to be submitted to a printer a short time in the future are taken into consideration for purposes of scheduling two-sided printing.

SUMMARY

According to one embodiment, there is provided a method of operating a printing apparatus, the apparatus having a rotatable imaging member and an imaging station useful in creating printable images and test patches on the rotatable imaging member. Data is obtained relating to images desired to be printed in a timeframe corresponding to a predetermined number of rotations of the imaging member. A gap is identified in the time-frame corresponding to a location on the imaging member that is not occupied by an image desired to be printed within the time-frame. The identified gap is identified as suitable for receiving a test patch. A control system is informed that the identified gap is available for placement of a test patch thereon.

DETAILED DESCRIPTION

Figure 1:
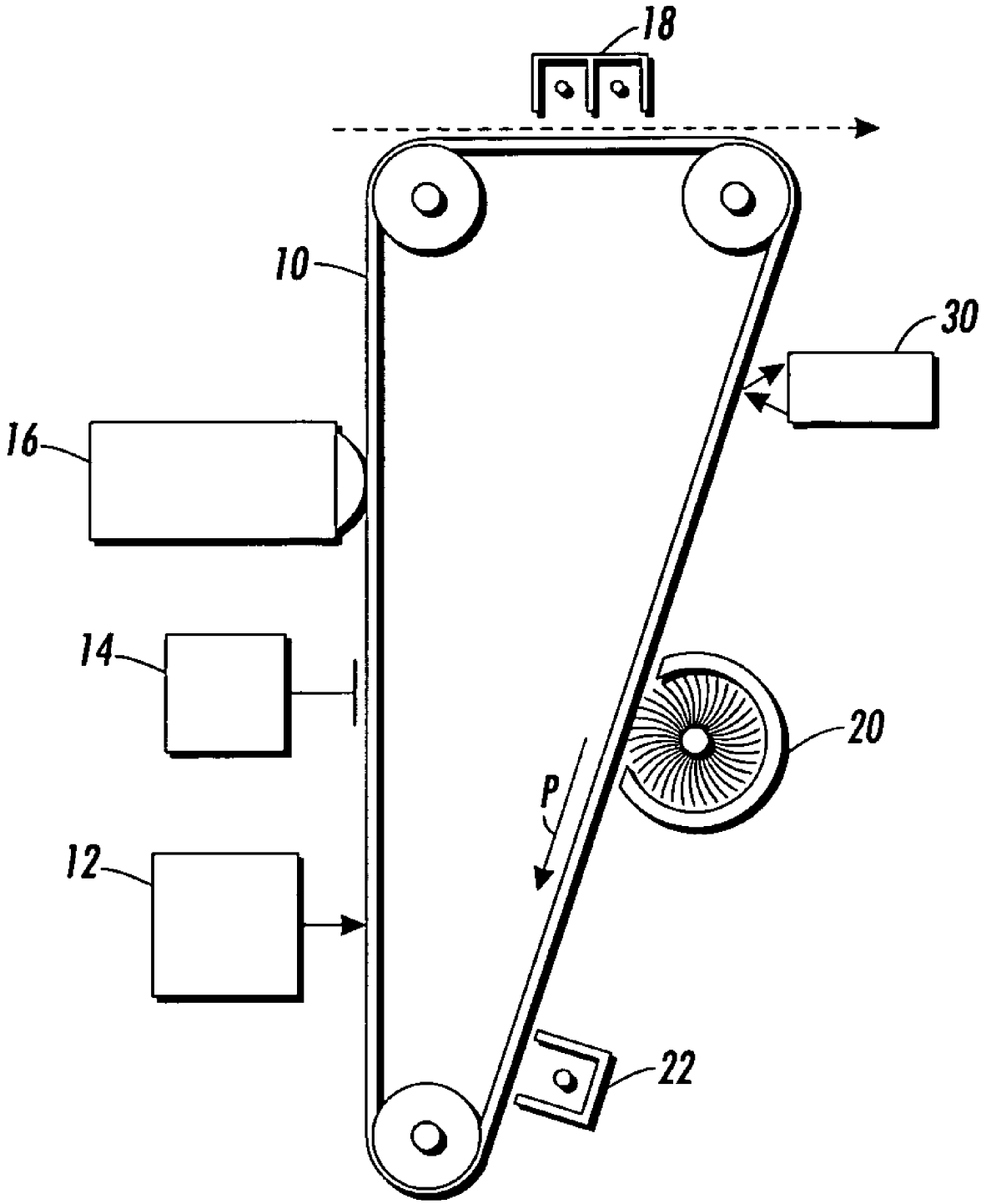
FIG. 1 (PRIOR ART)
FIG. 1 is a simplified elevational view of the basic elements of a xerographic printer.

FIG. 1 is a simplified elevational view of the basic elements of a xerographic "laser" printer, as is generally familiar in the art. Although a monochrome, xerographic printing apparatus with a photoreceptor belt is shown and described in the present embodiment, the claimed invention can be applied to other printing technologies, such as ink-jet or offset, and can be applied to any color apparatus in which multiple color separations are "built up" in one or more cycles on a rotatable image member to form a full-color image.

In the FIG. 1 embodiment, a rotatable imaging member is in the form of a belt photoreceptor 10 (although other types of imaging member are applicable, such as in other printing architectures and technologies). The photoreceptor 10 rotates along a process direction P. With regard to any small area on the outside surface of photoreceptor 10, the area is first initially charged by a charging device 22. An electrostatic latent image, based on an image desired to be printed, is created by using a laser 12 to discharge certain areas of the photoreceptor surface. Broadly speaking, the laser 12 and its ancillary optical elements form an "imaging station;" other types of imaging station could include an ink-jet printhead, or any other device that causes a desired image or latent image to be placed on the rotatable imaging member. In certain types of printing systems, the condition of the photoreceptor 10 after image exposure can be monitored by an electrostatic voltmeter 14. The suitably-charged areas are then developed with developer unit 16, which in this case places toner particles in imagewise fashion on the surface of photoreceptor 10. The toner, or more broadly marking material, is then transferred to a print sheet (not shown) at a transfer station 18. Any residual toner remaining on the photoreceptor 10 after image transfer is cleaned by a cleaning device 20, so that the photoreceptor surface can be recharged at charging device 22 to receive another image.

At times when it desired to place a test patch on the surface of photoreceptor 10, the laser 12 is used to place a latent image on the photoreceptor 10, such that, when the latent image is developed with developer unit 16, a test patch of desired properties (such as optical density) results. In the FIG. 1 embodiment, the developed test patch is then monitored for density by a test patch monitor 30, seen here downstream of the transfer station 18. As mentioned above, when test patches are deployed, the marking material for the patches is typically not transferred to a print sheet at transfer station 18, and so a relatively large quantity of marking material must be removed by cleaning device 20. In many cases, the photoreceptor 10 must cycle the test patch multiple times (typically two or three times) past cleaning device 20 to remove all the marking material, so that the area can be used for placing an image thereon. Also, it would not be desirable to place a subsequent test patch in the same place as an imperfectly removed previous test patch, as the residual marking material would adversely affect the testing of the new test patch.

Figure 2:
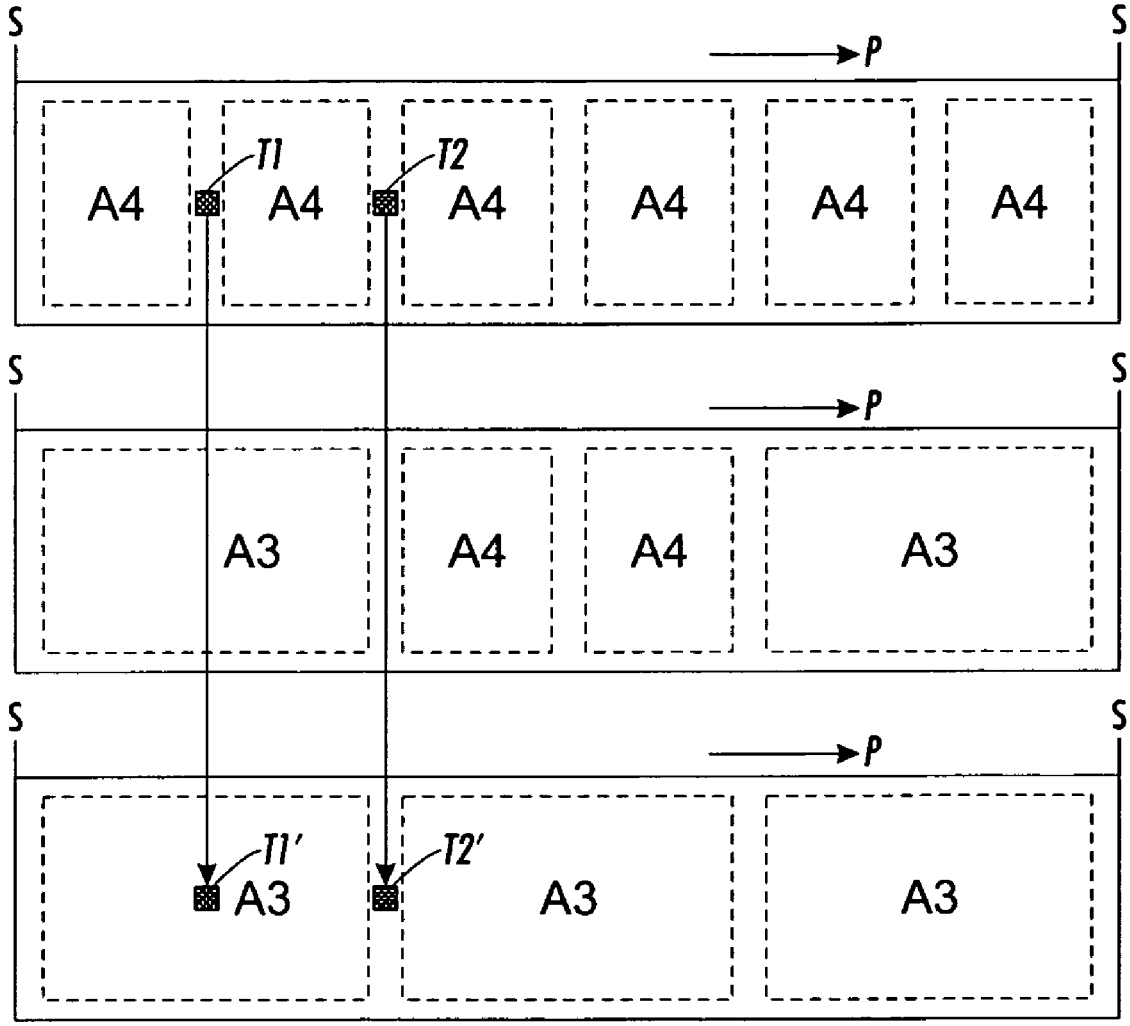
FIG. 2 is a plan view of a belt photoreceptor "flattened out" over three rotations thereof.

FIG. 2 is a plan view of the photoreceptor 10 "flattened out" over three rotations thereof. In the following discussion, it will be assumed that the apparatus is designed to create, as needed, either "one pitch" (letter or A4) or "two pitch" (11×17 inch or A3) images, although other image sizes would be possible in other practical embodiments. As shown, the two ends of the photoreceptor 10 are marked by a seam S, which here is used merely to demarcate separate rotations of the photoreceptor 10. In the embodiment, each rotation of the photoreceptor 10 accommodates six one-pitch images, indicated as A4 for convenience; three twopitch images, indicated as A3 for convenience; or some combination of one-pitch and two-pitch images within each rotation as desired and as physically possible.

Test patches are placed at various locations in "interdocument zones" between image areas, typically some predetermined safe distance from areas where an image would be placed, so that marking material from the test patches would not accidentally be transferred to a print sheet as part of an image to be printed. Taking the example of a test patch T1 placed as shown, and assuming there must be three rotations of photoreceptor 10 before the test patch T1 is fully erased, it can be seen that, once the test patch T1 is placed, the area on which the test patch T1 has been placed is precluded from receiving an A3 image two rotations in the future, as shown by the patch T1', which is the same test patch T1, only two rotations later, and not completely erased. However a test patch such as show at T2, which two rotations later would be disposed between two A3 image areas, would be allowable. Of course, one way to ascertain whether the placement of a test patch at T2' would be allowable is to populate a future time-frame of images to be printed, and see what gaps are available.

To address such a problem, a scheduling system must take into account the placement of images on the rotating photoreceptor 10 for one or more rotations in the future after a test patch has been placed, thus avoiding (or at least somehow taking into account) situations where the presence of an insufficiently erased test patch interferes with placement of a subsequent image.

Figure 3:
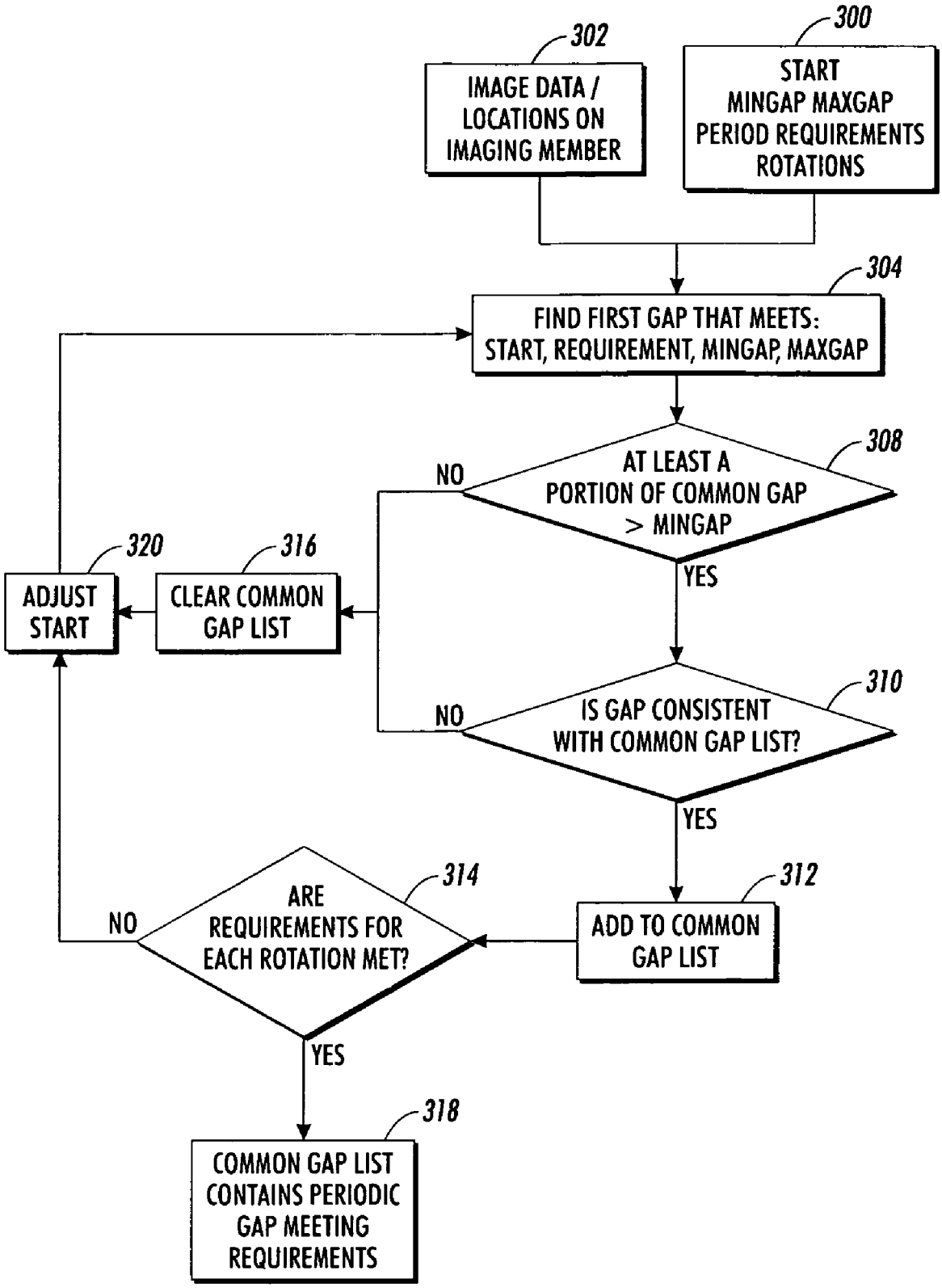
FIG. 3 is a flowchart showing the basic steps, to be undertaken by a control system operative in a printing apparatus for scheduling test patches in the printing apparatus.

FIG. 3 is a flowchart showing the basic steps, to be undertaken by a control system operative of the printing apparatus, for scheduling test patches in the printing apparatus. More specifically, the steps shown in FIG. 3 start with some basic data about how a rotatable imaging member, such as a photoreceptor, will be occupied with image data for an upcoming time-frame corresponding to a predetermined number of rotations in the future, and then identifies suitably-sized "gaps," where no image will be affected, as corresponding to places where a test patch can be placed and then remain on the photoreceptor for a predetermined number of rotations until it is erased. In a practical application, the steps shown in FIG. 3 take place in the time between the printer being instructed to output certain images for a certain amount of time in the future (corresponding to a certain number of photoreceptor rotations) and the actual placement of the images, such as through a ROS or other imaging device, on the photoreceptor. In the following discussion, the "domain" of the data is time, but time corresponds to a position, along the process direction, on the constant-velocity-moving photoreceptor. Durations of time in the future suitable for placing of test patches, as determined by the method, are retained in a "list," and other control systems within the control system are ultimately advised that a suitable gap is available for placement of a test patch as needed.

Looking first at step 300 in FIG. 3, the method starts with some basic data in identifying a gap of suitable size and location. START is a variable representing the start of a considered "window" or time-frame in which images and test patches are scheduled. One criterion for test patches is MINGAP, the minimum necessary size for a gap that can accommodate a test patch and any required spacing relative to a neighboring image area on the photoreceptor. Another criterion is MAXGAP, the largest suitable size for a gap, with the consideration that very large gaps would have the effect of taking up space on the photoreceptor that could be used for imaging. PERIOD is the amount of time corresponding to one rotation of the photoreceptor. REQUIREMENTS is a set of data characterizing one or more types of test patch, particularly as relating to size and spacing requirements relative to neighboring image areas. ROTATIONS is a number of rotations needed, given a particular type of test patch, that is required to erase the test patch sufficiently.

At step 302, the method receives image data for prints desired to be made in the next ROTATIONS number of rotations of the photoreceptor and stores their locations in a data structure for later reference. At step 304, the method seeks gaps in the rolling time-frame that satisfy the MINGAP, MAXGAP, and REQUIREMENTS variables, and then a candidate GAP is thus identified in terms of its start and end points in time.

Each candidate GAP identified is then tested such as at steps 308 and 310. At least a portion of the GAP must be greater than MINGAP (step 308), and the GAP must be consistent with other gaps previously entered on the list, if any (step 310). This consistency may take into account the variables for PERIOD and ROTATIONS. If these conditions are true, the GAP itself is added to the list, and the larger control system is informed that the gap is available, should the control system want to place a test patch at that time (step 312). The method then recycles to look for another suitable gap by checking for consistency in further cycles of the photoreceptor (step 314). If the GAP is consistent for all ROTATIONS, test patches may be scheduled in the GAP (step 318).

If the candidate GAP is inconsistent with scheduled images in the time frame, the GAP is excluded from the schedule (step 316). Whether a candidate GAP is scheduled or not, the scheduling process continues effectively in real time by updating the START time images are scheduled in the printer (step 320), and information about newly-scheduled images is obtained.

While the present disclosure is directed to a monochrome, xerographic printing apparatus, the teachings and claims herein can be readily applied to color printing apparatus, and to any rotatable imaging member such as an intermediate belt or drum as used in xerography, ionography, production ink-jet, or offset printing.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A method of operating a printing apparatus, the apparatus having a rotatable imaging member and an imaging station useful in creating printable images and test patches on the rotatable imaging member, comprising:

obtaining data relating to images desired to be printed in a time-frame corresponding to a predetermined number of rotations of the imaging member;

identifying a gap in the time-frame corresponding to a location on the imaging member that is not occupied by an image desired to be printed within the time-frame;

determining that the identified gap is suitable for receiving a test patch; and informing a control system that the identified gap is available for placement of a test patch thereon.

2. The method of claim 1, wherein the predetermined number of rotations of the imaging member is greater than one.

3. The method of claim 1, the determining including determining whether a candidate gap is of a minimum size and a maximum size.

4. The method of claim 1, the obtaining occurring effectively in real time.

* * * * *